United States Patent [19]

Kunitomo

[11] Patent Number: 5,069,129

[45] Date of Patent: Dec. 3, 1991

[54] IGNITING APPARATUS FOR EXPLOSIVE SUBSTANCES

[76] Inventor: Shigeaki Kunitomo, Nakanocho 580.581 Ban Gacchi, Teramachi-dori Bukkoji Agaru, Shimogyo-ku, Kyoto, Japan

[21] Appl. No.: 610,089

[22] Filed: Nov. 7, 1990

[51] Int. Cl.[5] ..... F42D 1/055

[52] U.S. Cl. ..... 102/200; 102/217

[58] Field of Search ..... 102/200, 206, 217, 311, 102/360

[56] References Cited

U.S. PATENT DOCUMENTS

| | | | |
|---|---|---|---|
| 4,537,131 | 8/1985 | Saunders | 102/217 |
| 4,632,031 | 12/1986 | Jarrott et al. | 102/206 |
| 4,641,580 | 2/1987 | Ogatsu | 102/217 |
| 4,848,232 | 7/1989 | Kurokawa et al. | 102/206 |
| 4,884,506 | 12/1989 | Guerreri | 102/200 |

*Primary Examiner*—Charles T. Jordan
*Attorney, Agent, or Firm*—Morgan & Finnegan

[57] ABSTRACT

A program-controlled automatic ignition apparatus comprising: a number of ignition circuits for igniting explosive charges, a plurality of terminal control units 6*a*, 6*b*, 6*c*, . . . disposed in the vicinity of a location where explosive charges 17 are set, for managing divided groups of the ignition circuits, respectively, and controlling them individually, while monitoring the loaded state of the explosive charges 17 in the circuits, a central control unit 1 for controlling the ignition circuits through the terminal control units 6*a*, 6*b*, 6*c*, . . . according to the program so as to successively ignite them, and an interface unit 2 for transmitting instructions from the central control unit 1 to the individual terminal control unit.

1 Claim, 3 Drawing Sheets

IGNITING APPARATUS FOR EXPLOSIVE SUBSTANCES

FIELD OF THE INVENTION

The present invention relates to an apparatus for controlling the ignition of a number of explosive charges, for example, skyrockets from a location remote from the shooting location.

BACKGROUND ART

For example, in the case where 1,000–10,000 fireworks are to be shot in a predetermined order in a fireworks display, if use is made of conventional ignition methods including one in which a fire source, such as a burning match, is thrown into shooting powder filled below a fireworks ball received in a gun barrel and another in which fireworks are tied by a fuse string and ignited in unison, the operation is very troublesome and there is a danger of the operator making a mistake in the ignition order or getting burnt. In recent years, in an effort to solve such problems caused by manual operation, an ignition mechanism similar to an electric detonator for explosives has been applied to gun barrels; thus, ignition pellets set in a plurality of gun barrels are respectively energized by a plurality of ignition circuits to successively shoot fireworks.

However, the electric igniter described above has to be provided with parallel circuits corresponding in number to fireworks. Moreover, for remote control, it is necessary to lay circuits extending far to the control location and the ignition operation according to the program is not easy if the operator resorts to push-button operation alone. In the explosive igniting technique in the step-by-step generation electric detonating system, a delay device (explosive) is installed between an ignition pellet and a detonating charge so that the explosive charges are sequentially detonated in the order determined by the delay even if simultaneous ignition is adopted. However, if this method is applied to skyrockets, it is difficult to obtain a suitable time interval and, moreover, the number of fireworks that can be handled at a time is limited to within several tens.

DISCLOSURE OF THE INVENTION

An object of the present invention is to provide an ignition apparatus for successively igniting a number of explosive charges according to a program, wherein the wiring used is not complicated and the operation is so simple that there is no possibility of misoperation.

To achieve the object described above, a program-controlled automatic ignition apparatus is characterized by comprising:

a) a number of ignition circuits for igniting explosive charges, said circuits being divided into a plurality of groups;

b) a plurality of terminal control units each disposed in the vicinity of a location where explosive charges are set, for managing said plurality of groups of said circuits, respectively, and controlling said circuits individually, while monitoring the loaded state of the explosive charges in the circuits, c) a central control unit for controlling said ignition circuits through said terminal control units according to said program so as to successively ignite them, and d) an interface unit for transmitting instructions from said central control unit to the individual terminal control units.

In the above arrangement, when explosive charges are skyrockets, ignition pellets to be connected to the ignition circuits are set in the bottoms of the gun barrels, so that the explosive charges thereabove are energized and detonated.

Therefore, the computer sends control signals to the terminal control devices via a signal line for circuit alone to the location where explosive charges are set, these terminal control units being adapted to individually ignite the explosive charges in the order determined for the control signals.

EMBODIMENTS

Figure 1:
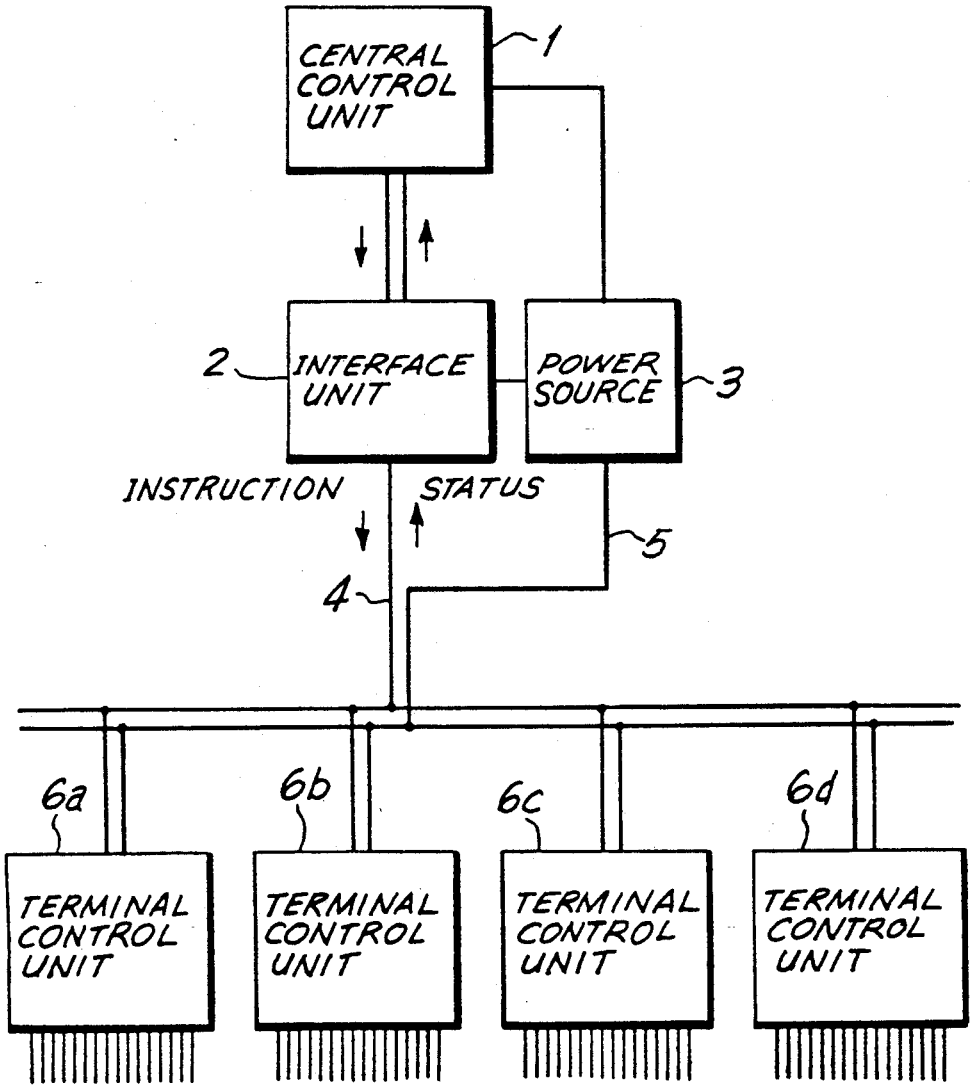
FIG. 1 is a block diagram showing the system arrangement of an embodiment of the invention.

FIG. 1 is a block diagram showing the system arrangement of an embodiment of the present invention. This system comprises a central section consisting of a central control unit 1, an interface unit 2 and a power source 3, and a terminal section consisting of a plurality of terminal units 6*a*, 6*b*, 6*c*. . . installed in a location where explosive charges which, in this case, are skyrockets, are set, said terminal units being connected to the interface unit 2 and power source 3 respectively through a signal line 4 and a power line 5.

In the above system, the central control unit 1 is, for example, a personal computer, and an execution plan prepared in advance according to a program is used as a terminal program to be sent to the terminals through the interface. The system is started by operator's manual operation or automatic procedure, and execution control of program ignition is effected.

The interface unit 2 performs electrical conversion and registration between the central control unit 1 consisting of a personal computer and the communication lines 4. In this case, it is to be understood that a maximum of 4 communication lines is handled by a single interface.

The communication lines 4 take charge of communication between the interface unit 2 and the terminal control units 6*a*, 6*b*, 6*c* . . . , each communication line consisting of a set of twist pair (two-line conductor). Each communication line is capable of controlling 31 terminal units; thus, for 4 circuits in 1 system, $31 \times 4 = 124$ terminal units can be controlled.

A terminal control unit is a terminal equipment having an information processing function containing a microcomputer and in response to instructions from the central control unit 1, it checks up the execution of ignition and the connected condition of ignition pellets connected to the terminal numbers designated by instructions from the central control unit 1 and reports the result of checkup or the result of execution to the central control unit. In this case, one terminal control unit is capable of controlling 50 ignition pellets.

Figure 2:
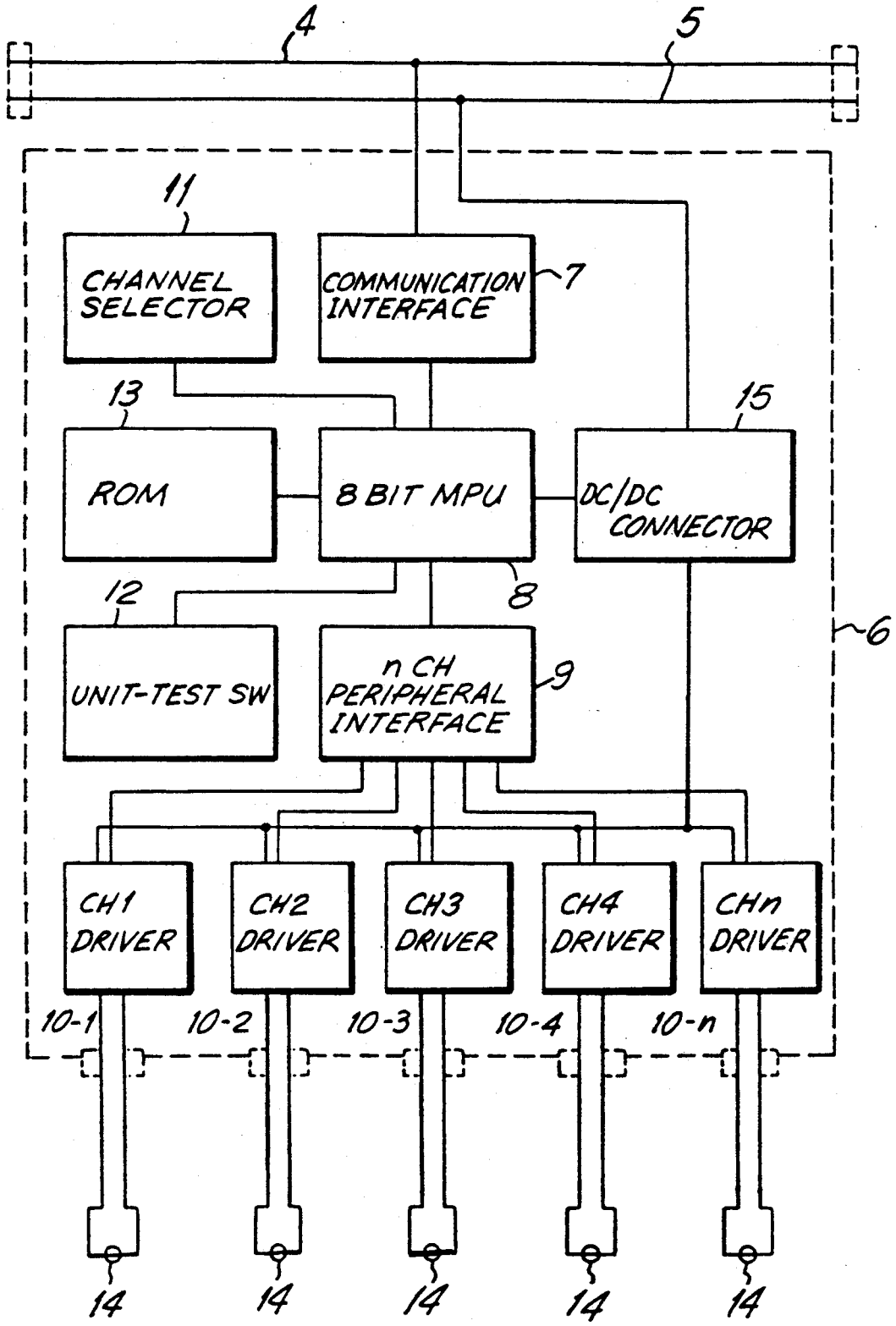
FIG. 2 is a block diagram showing the arrangement of a terminal control device.

FIG. 2 is a block diagram showing the arrangement of a terminal control unit (collectively shown at 6). The terminal control unit 6 has a basic circuit consisting of an interface unit 7 similar to a central interface, a signal processing section 8 in the form of an 8-bit microprocessor for processing instructions received from the center via the interface unit 7, an n-channel peripheral interface unit 9 for dividing the control signal from said signal processing section 8 to energize terminal units (control circuits and ignition pellets), and drive circuits 10-1, 10-2, 10-3 . . . 10-n connected to the channels. Connected to the signal processing section 8 are a channel selector 11 constructed as a terminal operating switch, a unit test switch 12 and a read only memory 13 assisting in signal processing. The drive circuits 10-1, 10-2, 10-3, . . . 10-n respectively electrically energize ignition pellets 14 set in skyrockers or the like, the energizing current being supplied to the drive circuits by a DC-DC converter connected to a power source.

Figure 3:
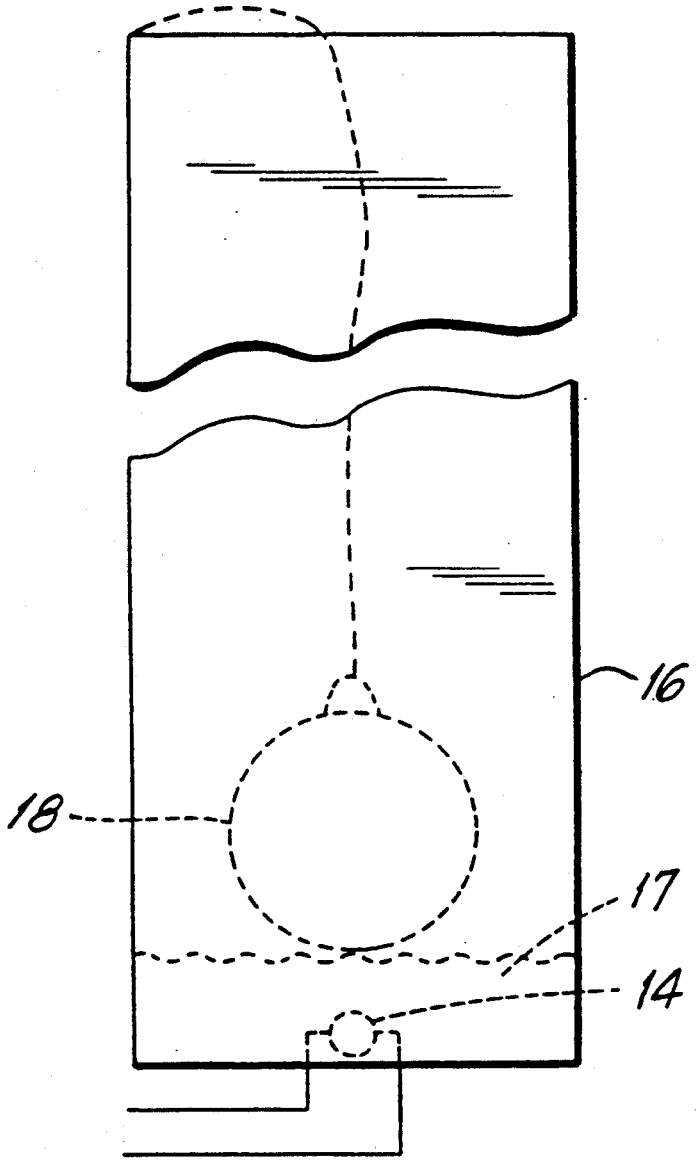
FIG. 3 is a side view showing the construction of a skyrocket to which an apparatus of the invention is applied.

FIG. 3 schematically shows an ignition pellets set in a skyrocket. Shooting powder 17 is put on the bottom of a gun barrel 16 for the skyrocket and a fireworks ball 18 is placed thereon. On the bottom surface of the gun barrel, the ignition pellet 14 is set under the shooting powder 17; thus, when ignition pellet 14 is energized by the drive circuit, the shooting powder is detonated by the ignition energy produced by the ignition pellet.

In addition, in the case of set fireworks, ignition pellets will be mounted at the initial ends of fuse strings connected to the fireworks themselves.

Further, it is clear that the remote ignition control system of the present invention is applicable not only to fireworks but to explosives in general.

As has so far been described, according to the system of the invention, since ignition control can be effected in a suitable location remote from a fireworks shotting or setting location, automatic remote control free from accidents resulting in injury or death can be attained. Further, in the field of fireworks, it becomes possible to shoot fireworks at a plurality of locations at the same time, a fireworks shooting method which has heretofore been regarded impossible, whereby the stage effect can be further promoted.

Since the terminal control units are connected by very short branches of communication lines (multi-drop system) extending to the terminals, it is only necessary to prepare a single twist pair for communication and a single power cable used for power source, extending from the central control device to the location.

Therefore, it is possible to avoid the danger of mutual interference or erroneous connection caused by laying a plurality of long circuits.

In the system, the order of ignition at the terminals can be set according to the line number, the terminal unit number and the terminal number in each terminal device, it is clear that there is no danger of making a mistake in the order of connection of communication lines in the location.

Further, since the communication lines allow communication in dual direction between the center and the terminals, the conditions in each stage (whether the operation is possible, whether the connection of the terminal is ready, etc.) can be monitored at the central control unit without having to go to the shooting location. Control signals to the terminals are subjected to parity check or other logical test, whereby errors due to noise and the like can be avoided.

What I claim is:

1. A program-controlled automatic ignition system for pyrotechnics, comprising:

a) a number of ignition circuits for igniting pyrotechnic devices, said circuits being divided into a plurality of groups;

b) a plurality of terminal control units disposed in proximity to the pyrotechnic devices for managing said plurality of groups of said number of ignition circuits and for controlling said ignition circuits individually while monitoring the loaded state of the pyrotechnic devices on the ignition circuits;

c) a central control unit for controlling said ignition circuits through said terminal control units according to a preset program to successively ignite the pyrotechnic devices;

d) an interface unit for transmitting instructions from said central control unit to the individual terminal control units;

e) a power source for said number of ignition circuits; and f) each of said plurality of terminal control units including signal processing means comprising a microprocessor unit which is operable in accordance with the instructions of said central control unit, n-channel peripheral interface means connected to said signal processing means for n-ignition circuits constituting said group each of which consists of a channel driver and an ignition pellet of one of the pyrotechnic devices in circuit with said channel driver, a channel selector connected to said signal processing means for preselecting at least one channel of said n-channel peripheral interface means, a unit-test switching means connected to said processing means for selectively testing at least one channel of said n-channel peripheral interface means, and unit power supply line conductors connected to said power source and said n-ignition circuits in sequential shunt relationship.

* * * * *